US006951039B2

(12) United States Patent
Roseff

(10) Patent No.: US 6,951,039 B2
(45) Date of Patent: Oct. 4, 2005

(54) COMBINATION MATTRESS AND SHIPPING CONTAINER AND METHOD OF USE

(76) Inventor: Kevin Roseff, 11755 Bayfield Dr., Boca Raton, FL (US) 33498

( * ) Notice: Subject to any disclaimer, the term of this patent is extended or adjusted under 35 U.S.C. 154(b) by 0 days.

(21) Appl. No.: 10/366,019

(22) Filed: Feb. 11, 2003

(65) Prior Publication Data

US 2004/0154105 A1 Aug. 12, 2004

(51) Int. Cl.[7] ..... A47C 27/08
(52) U.S. Cl. ..... 5/706; 5/706; 5/654
(58) Field of Search ..... 5/413 AM, 706, 5/654, 653

(56) References Cited

U.S. PATENT DOCUMENTS 3,877,092 A * 4/1975 Gaiser ..... 5/413 R
4,604,765 A * 8/1986 Schultz ..... 5/413 AM
4,862,533 A * 9/1989 Adams, III ..... 5/413 R
5,136,981 A 8/1992 Barreto, III et al.
5,611,414 A * 3/1997 Walker ..... 5/420
5,640,725 A * 6/1997 Ando et al. ..... 5/419 AM
5,644,807 A * 7/1997 Battistella ..... 5/419
5,740,565 A * 4/1998 McDade ..... 5/413 AM
6,223,367 B1 * 5/2001 French et al. ..... 5/419
6,543,072 B2 * 4/2003 Hsu ..... 5/413 R
6,675,414 B2 * 1/2004 Lamke ..... 5/413 AM
2002/0104162 A1 * 8/2002 Stewart ..... 5/413 AM
2002/0133879 A1 * 9/2002 Smith et al. ..... 5/413 R

OTHER PUBLICATIONS

Best Care Corporation (brochure), *Dyna Series, DynaFlo 8000, Dynamic Low Pressure Pump and Low Air Loss Mattress System.*

* cited by examiner

*Primary Examiner*—Frederick L. Lagman
(74) *Attorney, Agent, or Firm*—McDermott Will & Emery LLP

(57) ABSTRACT

An inflatable, therapeutic air mattress for use by healthcare facilities has a permanently attached shipping container with a pocket for receiving a shipping label or card. In order to ship the same to a healthcare facility, the inflatable, therapeutic air mattress is rolled up and put in the permanently attached shipping container and sent to the healthcare facility, where the permanently attached shipping container is opened, and the inflatable, therapeutic air mattress is unrolled and inflated with a pump provided with the mattress. The permanently attached shipping container fits directly underneath the inflatable, therapeutic air mattress and does not inhibit set-up or patient use. When no longer needed, the inflatable, therapeutic air mattress can be easily deflated, rolled up and placed in the permanently attached shipping container and shipped back to the provider by any means of commercial air or ground shipment.

2 Claims, 7 Drawing Sheets

COMBINATION MATTRESS AND SHIPPING CONTAINER AND METHOD OF USE

BACKGROUND OF THE INVENTION

1. Field of the Invention

This invention relates to an inflatable, therapeutic air mattress which is inflated by a motorized pump and has an integral or permanently attached shipping container and the method of use thereof. The inflatable, therapeutic air mattress is used by various types of healthcare facilities (hospitals and nursing homes), as well as in the home care market.

2. Description of the Prior Art

It is uncommon to have an inflatable, therapeutic air mattress which can be deflated and folded to a flat condition and shipped in any type of container to a user. The industry's current lack of "shippability" requires a technician to deliver, assemble and inflate the mattress which adds considerable cost to the goods. At the location, the inflatable, therapeutic air mattress must be set up by a trained technician using an inflating air pump and placed on a frame.

This invention removes the necessity of a technician and enables the healthcare facility to use the same type of inflatable, therapeutic air mattress at a reduced cost.

SUMMARY OF THE INVENTION

An inflatable, therapeutic air mattress for use by healthcare facilities has a permanently attached shipping container with a pocket for receiving a shipping label or card. In order to ship the same to a healthcare facility, the inflatable, therapeutic air mattress is rolled up and put in the permanently attached shipping container and sent to the healthcare facility, where the permanently attached shipping container is opened, and the inflatable, therapeutic air mattress is unrolled and inflated with a pump provided with the mattress. The permanently attached shipping container fits directly underneath the inflatable, therapeutic air mattress and does not inhibit set-up or patient use. When no longer needed, the inflatable, therapeutic air mattress can be easily deflated, rolled up and placed in the permanently attached shipping container and shipped back to the provider by any means of commercial air or ground shipment.

BRIEF DESCRIPTION OF THE DRAWINGS

Further objects and advantages of the invention will become more apparent from the following description and claims and from the accompanying drawings, wherein:

DETAILED DESCRIPTION OF THE PREFERRED EMBODIMENT

Figure 8:
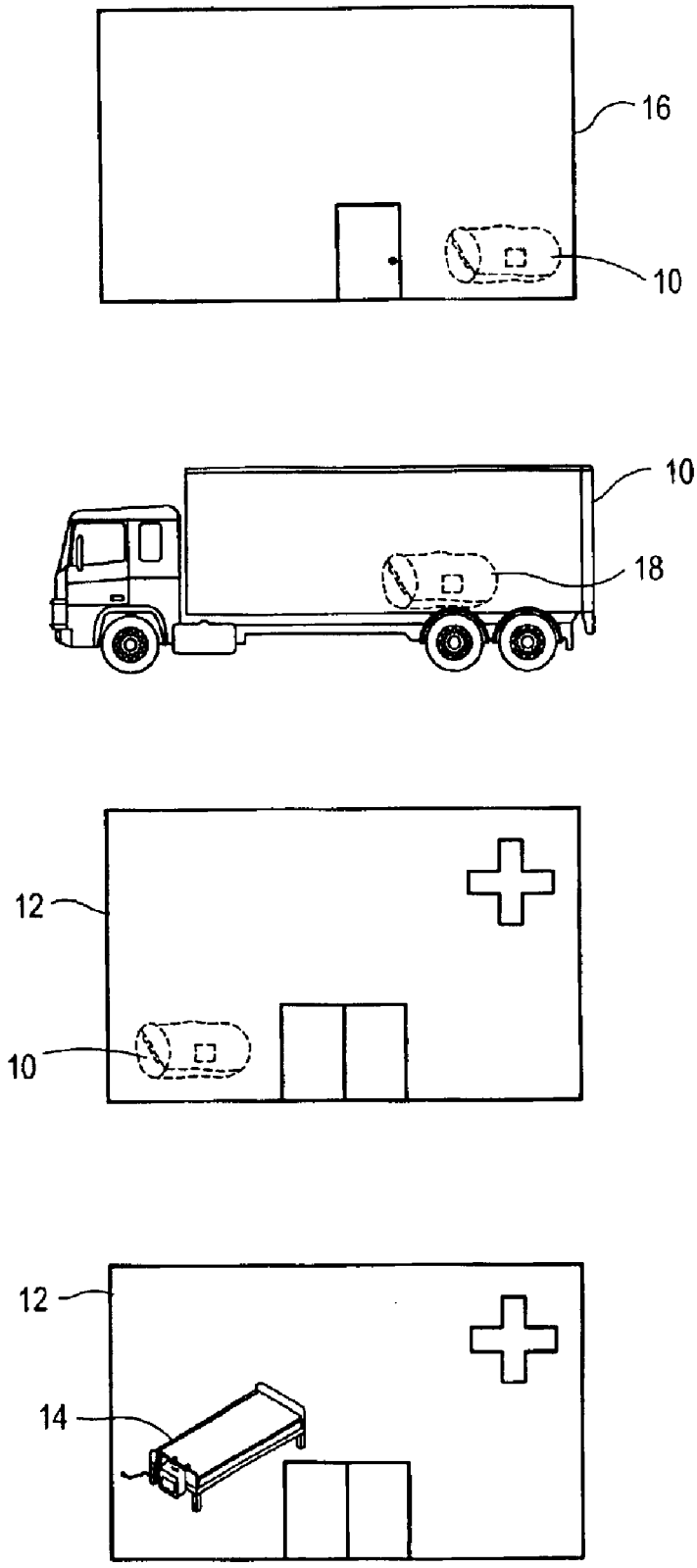
FIG. 8 is a schematic diagram illustrating the method of use of the combination mattress and shipping container of the present invention.

Further objects and advantages of the invention will become more apparent from the following description and claims and from the accompanying drawings, wherein FIG. 8 illustrates the utility of the combined mattress and shipping container 10 shown in FIGS. 1, 2, 3 and 4.

Figure 6:
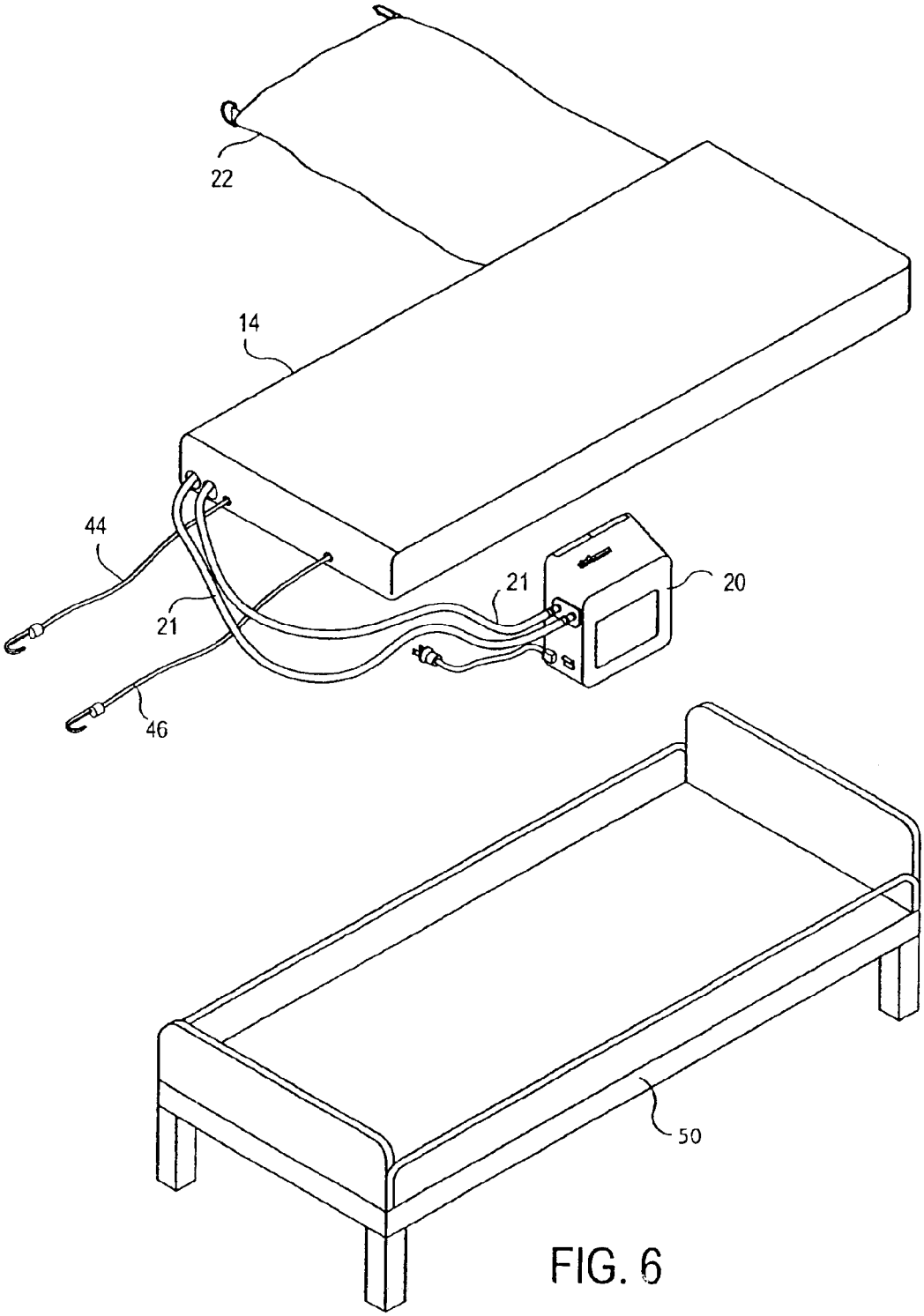
FIG. 6 is an exploded perspective view of the unrolled inflatable, therapeutic air mattress of the invention placed on a bed frame with its integral or permanently attached shipping container and illustrating the inflation of the same with an air pump provided in the shipping container and attached to the mattress.

In FIG. 8, a healthcare facility 12 in need of an inflatable, therapeutic air mattress would order an inflatable, therapeutic air mattress 14 from a manufacturer or supplier 16. The supplier 16 would ship the combined mattress and shipping container 10 via commercial air or ground shipment 18 to the healthcare facility 12, which can remove the mattress 14 along with an electric air inflation pump 20 and hose lines 21 attached to the mattress, from a shipping container 22, which is especially designed to meet the standards of most commercial shippers. As illustrated in FIG. 6, the mattress 14 can be inflated by healthcare personnel using pump 20 without the intervention of a trained technician and disposed on a suitable bed frame 50 and the shipping container 22 which is permanently attached to the mattress 14 disposed beneath the mattress 14 for subsequent use in either reshipment of the mattress 14 or use in storage of the mattress.

Figure 5:
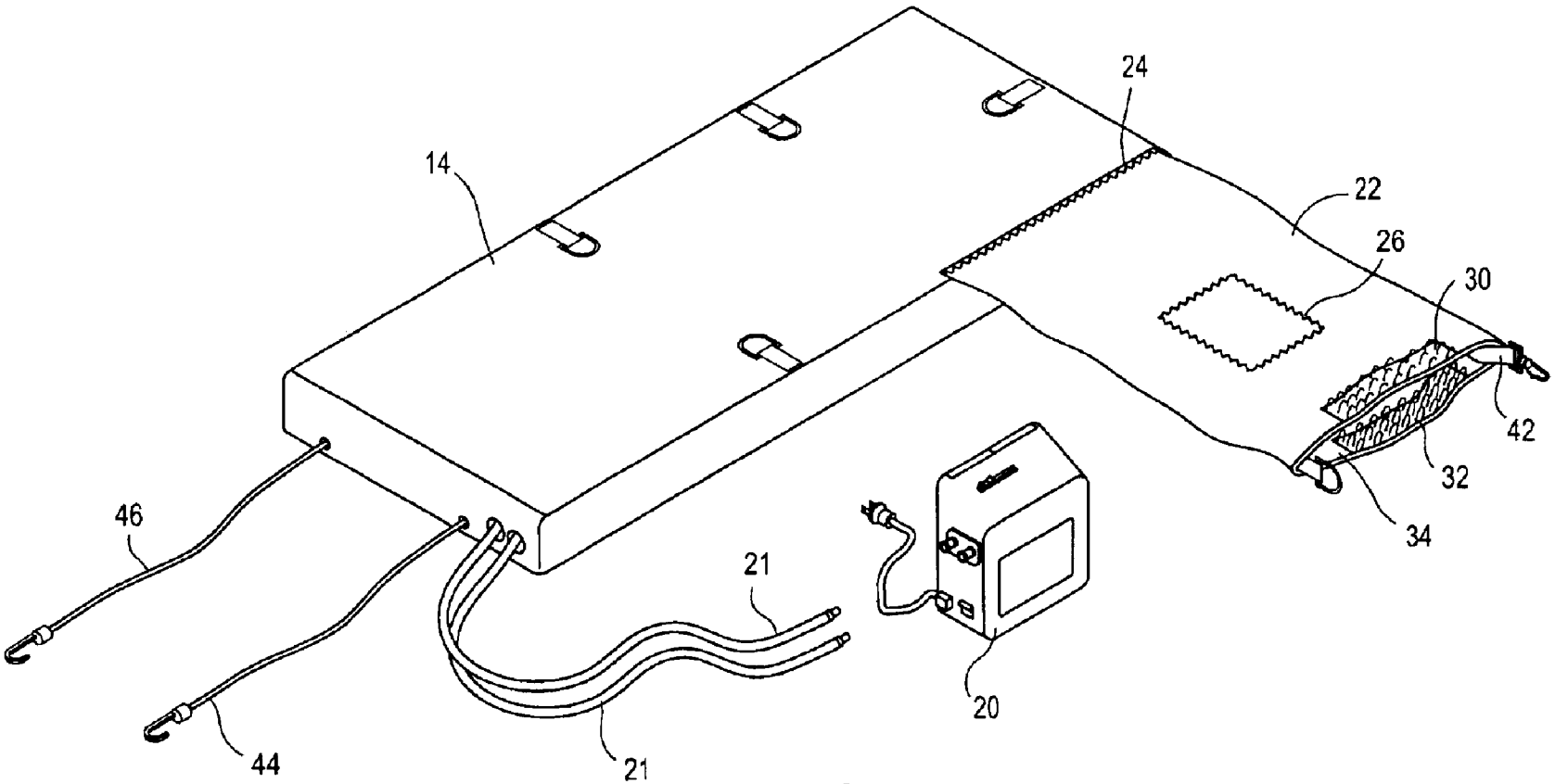
FIG. 5 is an exploded perspective of the unrolled contents removed from the permanently attached shipping container.

As shown in FIGS. 5 and 6, the shipping container 22 is permanently attached to the head of mattress 14 by sewing the same to the bottom surface of the mattress 24 perpendicular to the longitudinal axis of the mattress so it cannot be lost or misplaced. The exterior surface of shipping container 22 is provided with a pocket 26 for receipt of a shipping label 28. Additional fasteners are provided on shipping container 22 to assure that it does not open during shipment or storage. These fasteners 30, 32 consist of interlocking hook and eye or "Velcro" fasteners placed adjacent the top edges adjacent the mouth 34 of shipping container 22, for locking the mouth shut if the mattress is shorter than the length of the container or alternatively and additionally a strap 36 is laid across the mouth 34, which has a clip 38 on one end received in a buckle 40 connected by a piece of fabric 42 to the opposite side of sack 22.

Figure 1:
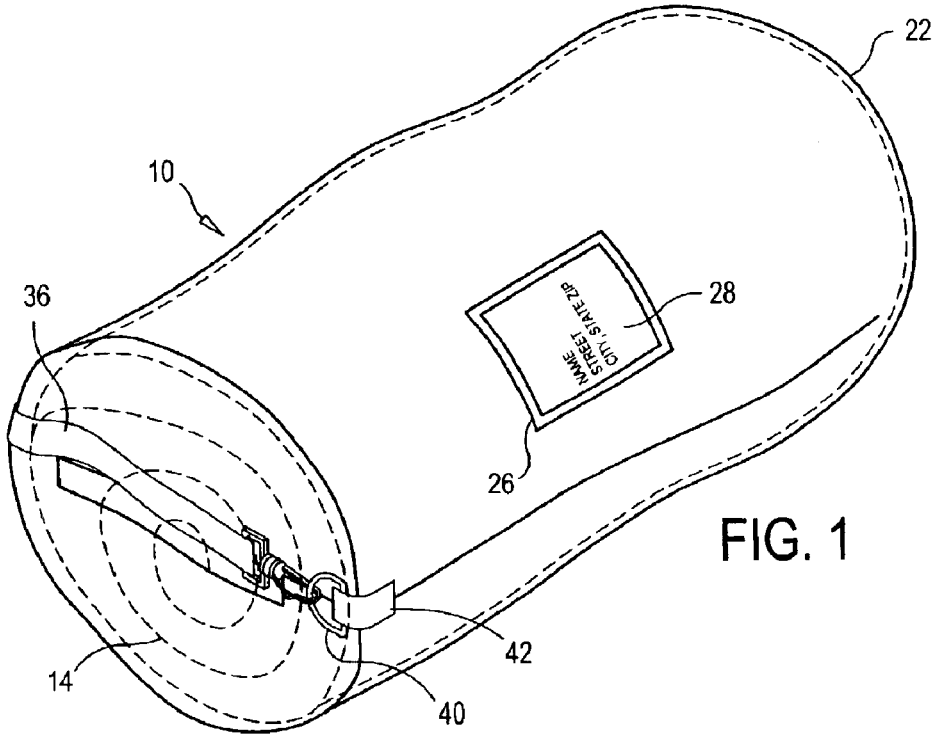
FIG. 1 is a perspective view of the inflatable, therapeutic air mattress of the present invention in a permanently attached shipping container.
Figure 2:
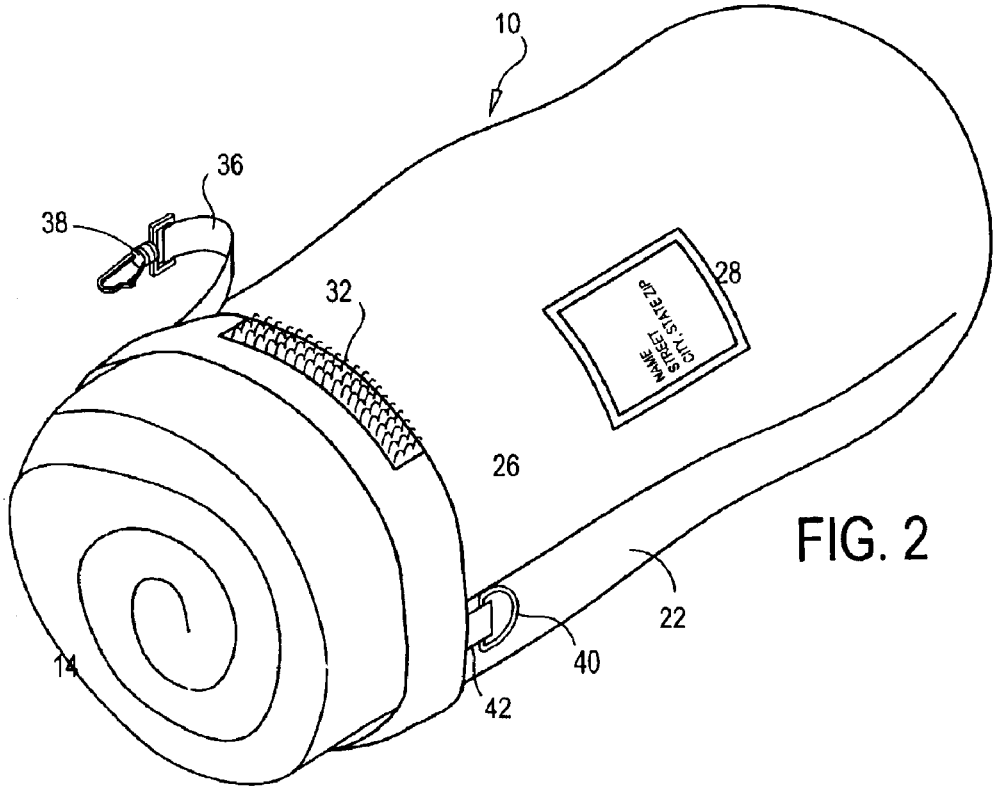
FIG. 2 is a perspective view of the permanently attached shipping container and inflatable, therapeutic air mattress of FIG. 1 with the shipping container opened and the mattress being removed.
Figure 3:
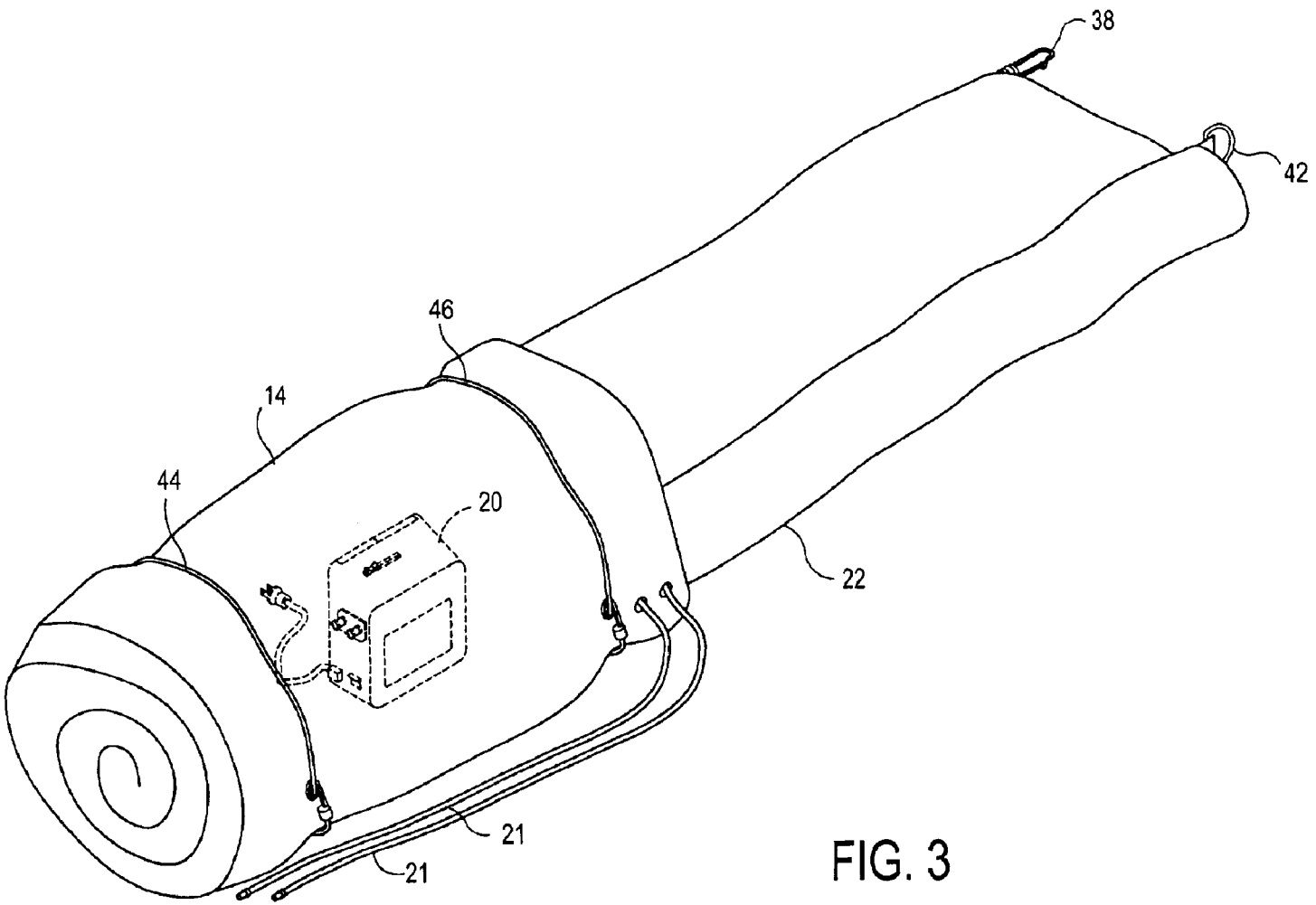
FIG. 3 is a perspective view similar to FIG. 2, with the inflatable, therapeutic air mattress fully removed from the permanently attached shipping container.
Figure 4:
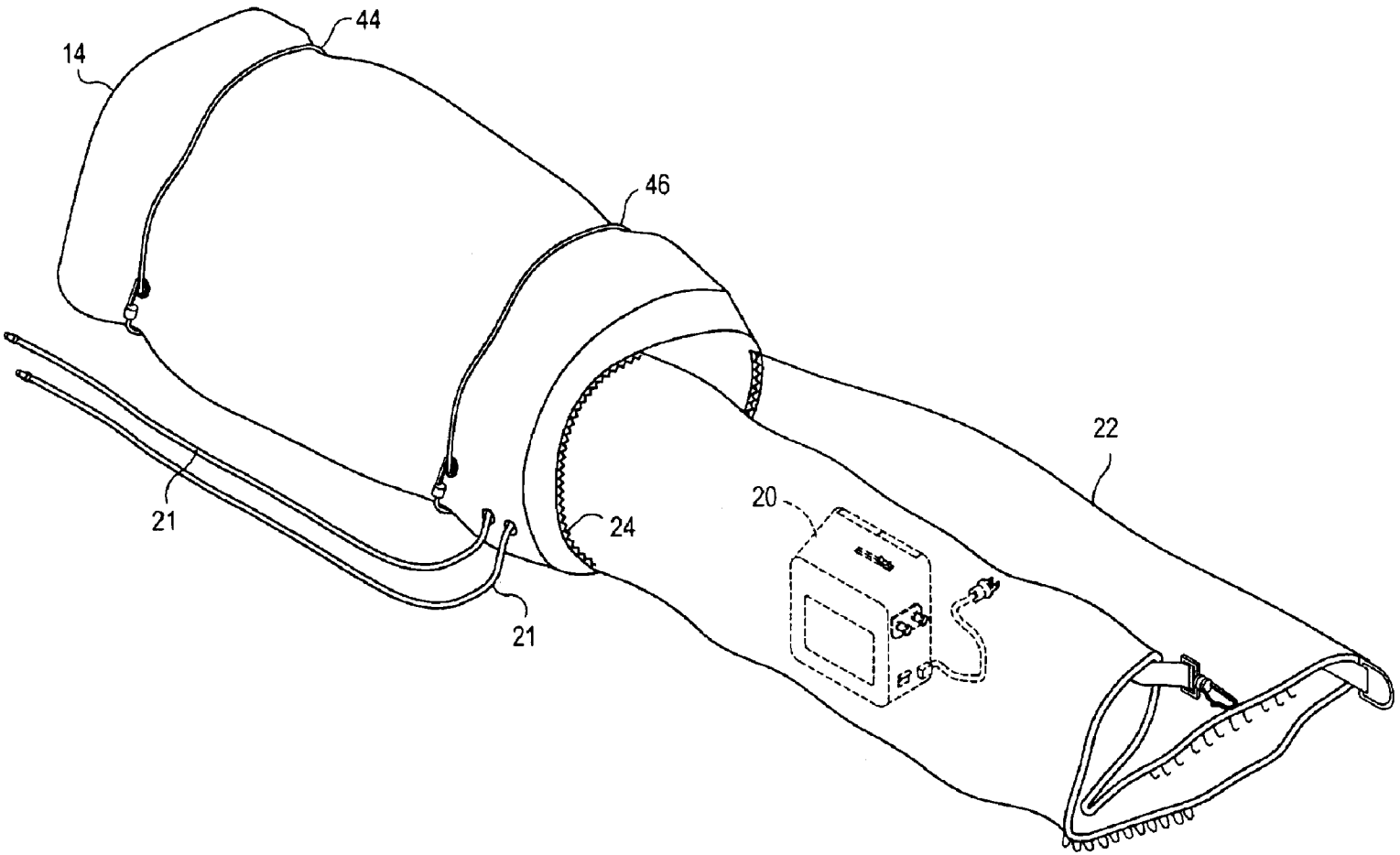
FIG. 4 is a view similar to FIG. 3 as seen from the opposite end of FIG. 3.
Figure 7:
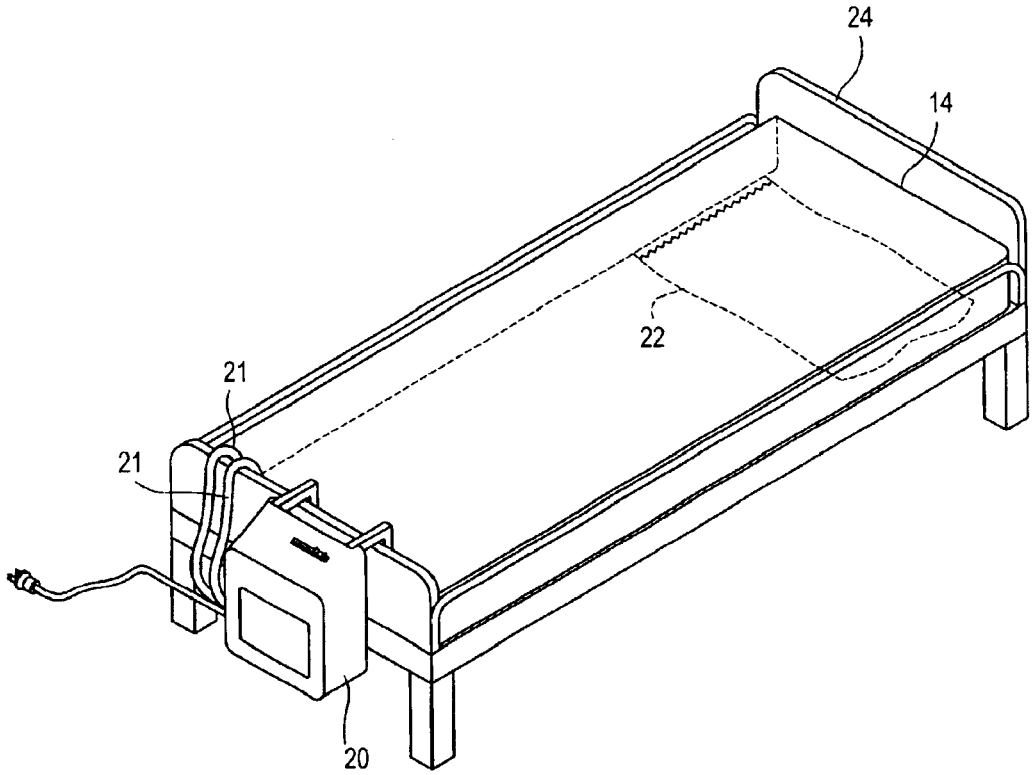
FIG. 7 is a perspective view of the components illustrated in FIG. 6 in assembled condition.

When rolled up for storage or reshipment, the inflatable, therapeutic air mattress 14 is deflated using pump 20 or a valve or valves (not shown) on the mattress 14 is opened. An integral bungee-type cord 44, 46 can be wrapped around the mattress 14 as shown in FIGS. 3 and 4 to retain the rolled mattress in a cylinder for easy insertion back into shipping container 22. In use, as shown in FIG. 7 the unrolled mattress 14 is turned over after inflation with the permanently attached shipping container 22 on the underside of the mattress, disposed between the mattress and frame 50 so it remains attacked to and integral with the mattress 14, but beneath the mattress out of view.

I claim:

1. A mattress combination, comprising:

an inflatable mattress; and a cover permanently attached to the mattress, the cover including an opening and a first seal proximate to the opening capable of substantially entirely closing the opening;

wherein the mattress is configurable in at least two configurations, in a first configuration, the cover surrounding the mattress, and in a second configuration, the cover extendable away from the mattress;

wherein the cover is permanently attached to the mattress proximate a bottom surface of the mattress; and wherein an edge of the cover permanently connected to the mattress is perpendicular to a longitudinal axis of the mattress.

2. A mattress combination, comprising:

an inflatable mattress; and a cover permanently attached to the mattress, the cover including an opening and a first seal proximate to the opening capable of substantially entirely closing the opening;

wherein the mattress is configurable in at least two configurations, in a first configuration, the cover surrounding the mattress, and in a second configuration, the cover extendable away from the mattress;

wherein the cover includes outside walls and inside walls, in the first configuration, the inside walls of the cover facing one another, and in the second configuration, the outside walls of the cover facing one another.

* * * * *